US005078901A

United States Patent [19]

Sparrow

[11] Patent Number: 5,078,901

[45] Date of Patent: Jan. 7, 1992

[54] AUTOMATIC FUEL DECONTAMINATION SYSTEM AND METHOD

[75] Inventor: John B. Sparrow, Columbus, Ind.

[73] Assignee: Cummins Engine Company, Inc., Columbus, Ind.

[21] Appl. No.: 406,620

[22] Filed: Sep. 13, 1989

[51] Int. Cl.[5] ..... F02M 37/00

[52] U.S. Cl. ..... 210/744; 210/114; 210/143; 210/171; 210/172; 210/416.4; 210/533; 210/800; 137/566

[58] Field of Search ..... 210/97, 143, 114, 257.1, 210/258, 260, 172, 313, 416.4, 744, 171, 745, 746, 532.1, 533, 800; 137/263, 172, 566, 571; 180/69.4; 280/834

[56] References Cited

U.S. PATENT DOCUMENTS

| | | | |
|---|---|---|---|
| 3,386,581 | 6/1968 | Gough | 210/86 |
| 3,677,284 | 7/1972 | Mendez | 280/834 |
| 4,049,072 | 9/1977 | Savage | 280/834 |
| 4,288,086 | 9/1981 | Oban et al. | 280/834 |
| 4,306,579 | 12/1981 | Kelly | 137/263 |
| 4,334,989 | 6/1982 | Hall | 210/114 |
| 4,495,069 | 1/1985 | Davis | 210/114 |
| 4,500,425 | 2/1985 | Thornton et al. | 210/136 |
| 4,539,109 | 9/1985 | Davis | 210/104 |

FOREIGN PATENT DOCUMENTS

| | | | |
|---|---|---|---|
| 82570 | 5/1984 | Japan | 210/97 |
| WO89/05685 | 6/1989 | PCT Int'l Appl. | 210/313 |

*Primary Examiner*—W. Gary Jones
*Assistant Examiner*—Matthew O. Savage
*Attorney, Agent, or Firm*—Sixbey, Friedman, Leedom & Ferguson

[57] ABSTRACT

The present invention provides a system for the automatic removal of contaminants such as water from the fuel supply of an internal combustion engine of the type including an auxiliary fuel tank. The system is automatically controlled and responsive to sensed contaminant levels in a contaminant removal mechanism and employs an existing fuel transfer pump to direct fuel around the auxiliary fuel tank through the contaminant removal mechanism. The pump additionally operates to provide a continuous supply of fuel to the engine to keep it operating while simultaneously permitting the discharge of contaminants from the contaiminant removal mechanism when a predetermined maximum contaminant level has been reached. This system is especially effective in removing water from the fuel system of a diesel engine powered vehicle such as a tank wherein the engine and auxiliary fuel tank are components of a power pack that is removable from the tank.

11 Claims, 2 Drawing Sheets

AUTOMATIC FUEL DECONTAMINATION SYSTEM AND METHOD

TECHNICAL FIELD

This invention relates to a system for continuously separating particulate and solid contaminants from the fuel line of an internal combustion engine. More specifically, the present invention is particularly useful in a diesel engine fuel supply system and provides a method and apparatus for automatically discharging water from the fuel supply system while the engine is running without allowing air to enter the fuel supply lines.

BACKGROUND OF THE ART

Although internal combustion engines perform well when clean, uncontaminated fuel is supplied to them, a fuel supply can be easily contaminated in various ways even when precautions are taken to keep the fuel clean. In humid environments or in areas of large temperature variations, condensation often forms on the inside of fuel storage tanks and drips down into the fuel, contaminating it. This problem is especially noticeable when small amounts of fuel are kept in large volume tanks. A majority of the volume of the tank in these situations is occupied by moisture laden air, and the percentage of water in the fuel becomes substantial. Moisture may also find its way into fuel supply systems in other ways. In boats or amphibious vehicles, for example, water from the environment may be introduced inadvertently into the fuel supply system when the fuel tank is filled. Additionally, older storage tanks may rust to a degree that permits contaminants to enter.

Due to the delicate nature of the parts required by compression ignition cycle engines, or diesel engines, moreover, it is extremely important that the diesel fuel supplied to the engines be free from high water content.

Since the contamination of fuel with water is common, a number of systems have been developed for separating water from fuel supply systems. A major problem faced by all of these systems is the elimination of contaminants without admitting other contaminants, such as air, into the fuel supply system through the water discharge opening. Fuel systems are especially prone to sucking air into the fuel supply lines when a discharge opening is located upstream of the fuel pump. Since this opening is located in an area of negative pressure, such systems require special provisions for overcoming the negative pressure before contaminants can be discharged.

U.S. Pat. No. 3,386,581 to Gough discloses an apparatus which may be used to drain water from a fuel tank. Gough, however, provides no apparatus for pressurizing the water separating apparatus before opening the outlet valve used to drain the water from the tank. As a result, the valve must be opened against the force of a vacuum, and air will be drawn into the vacuum when the valve is opened.

U.S. Pat. Nos. 4,495,069 and 4,539,109 to Davis disclose an automatic control means for automatically actuating a drain device in response to the detection of a predetermined quantity of water in a discharge chamber and then deactuating the drain device in response to the detection of a second lower quantity of water in the discharge chamber. In one embodiment of the Davis system, a pump is incorporated in a solenoid-operated discharge valve to overcome negative pressure at the exit of a canister from which water or other impurities are discharged. This additional pump, however, could increase significantly the cost and amount of labor required to manufacture the canister. Furthermore, by providing a pump only at the exit from the canister, the exit pump creates a vacuum opposing the vacuum already in the canister induced by the injection pump. The opposing vacuums may disrupt the flow of fuel to the engine, or, at least, slow down the draining procedure.

U.S. Pat. No. 4,500,425 to Thornton et al. discloses a hand-operated pump mounted upstream from a water separation unit. The pump is used to force fuel into a canister when a sump is drained in order to force out water that has collected in the sump. The hand-operated pump of Thornton et al., however, does not automatically discharge fluid during engine operation. The vehicle must first be stopped so that the plunger of the hand-operated pump can be operated manually to remove the contaminating water.

U.S. Pat. No. 4,334,989 to Hall discloses an automatic fuel-water separator and discharge device which employs a probe to sense water level. When the water level in the separator reaches the level of the probe, a solenoid is activated to force water out of a lower pump chamber. The Hall patent, however, does not disclose a pump upstream of the fuel-water separator or any other structure to overcome a negative pressure in the separator. Furthermore, the Hall device has only one probe; it therefore cannot detect when all of the water has been discharged. As a result, some quantities of fuel may be wasted because fuel is inadvertently discharged with the water. Finally, while the Hall device may work well for discharging small amounts of water, the repeated reciprocation of the plunger mechanism required to discharge large quantities of water could result in problems such as the development of leaks around the periphery of the plunger.

The available prior art systems for separating water from fuel, therefore, use supplemental pumps and pressurizing devices which add unnecessary manufacturing expense and vehicle weight. Additionally, the prior art systems also use small, inexpensive pressurization devices incapable of handling large volumes of water.

In short, no apparatus is known for automatically discharging desired quantities of water from the fuel supply of an internal combustion engine wherein existing fuel system structures are used to allow the automatic decontamination of the fuel supply while the engine is operating.

DISCLOSURE OF THE INVENTION

The primary object of the present invention is to overcome the disadvantages of the prior art and to provide an automatic fuel decontamination system which separates and discharges liquid contaminants from the fuel supply of a diesel engine while the engine is fully operating.

A more particular object of this invention is to provide an automatic fuel decontamination system which uses an existing pump for transferring fuel to an auxiliary fuel tank to pressurize a discharge opening from the fuel system to purge water from the system without allowing air to enter the discharge opening.

Another object of the present invention is to provide an automatic fuel decontamination system which allows fuel flow to bypass an auxiliary fuel tank when water is to be drained, thereby avoiding excessive pressures in and preventing rupture of the auxiliary fuel tank.

It is yet another object of the present invention to provide an automatic fuel decontamination system which continues to maintain a fuel supply to an engine-containing power pack from an auxiliary fuel tank in the fuel supply system if the power pack is separated from the main fuel tank.

Still another object of the present invention is to provide an automatic fuel decontamination system that can be used to automatically remove decontaminating water from the fuel supplies of tanks and amphibious vehicles during engine operation The above and additional objects of the subject invention are achieved by providing an automatic fuel decontamination system for an internal combustion engine including a main fuel tank fluidically connected by a main fuel flow path to an auxiliary fuel tank, a transfer pump for pumping fuel from the main fuel tank through the main fuel path to the auxiliary fuel tank, an injection pump for pumping fuel from the auxiliary fuel tank to an internal combustion engine, and a control system for controlling the transfer of fuel from the main fuel tank to the engine. The present automatic fuel decontamination system further includes a water separation and discharge system between the auxiliary fuel tank and the injection pump including maximum and minimum water level sensors. A fluid bypass provides an alternate flow path bypassing the auxiliary fuel tank to pressurize a water separator and discharge chamber. Solenoid valves actuatable in response to sensed maximum contaminant levels route fuel flow around the auxiliary fuel tank through the bypass. The system is pressurized by the transfer pump to allow the discharge of water and like contaminants from the discharge chamber when levels in excess of the predetermined maximum are sensed without subjecting the auxiliary fuel tank to excessive pressures.

Other more specific functional and structural advantages of the subject invention will be appreciated by a consideration of the following description, drawings and claims.

BEST MODE FOR CARRYING OUT THE INVENTION

The present invention consists of a method and apparatus for automatically discharging water from the fuel supplied to a diesel engine. As previously noted, because the fuel supplied to a diesel engine can become contaminated in various ways, it is desirable to provide apparatus capable of decontaminating the fuel supply to ensure proper vehicle performance. Although the present invention may be employed in any fuel system having an auxiliary fuel tank and a transfer pump for pumping fuel from a main fuel supply to the auxiliary fuel tank, it has been more specifically designed for use in a battle tank to be used in land combat. In such vehicles, the construction of the vehicle body is such that the engine is not always readily accessible for performance valuation or for necessary servicing. For this reason, engines have been developed for battle tanks that are easily removed as a power pack unit. Not only the engine, but also an auxiliary fuel tank is removed as a part of the power pack unit to provide a temporary fuel supply which permits the engine to be run outside of the engine compartment. A transfer pump, which is not removed with the power pack unit, is carried on the vehicle itself to maintain a predetermined level of fuel in the auxiliary tank.

The present invention is especially useful in the above described battle tank because the transfer pump can be used not only to maintain a predetermined level of fuel in the auxiliary tank, but the pump can also be used in a startup mode to charge the injection pump and additionally in a water discharge mode to pressurize the system to force water from the system. However, the present automatic fuel decontamination system and method is not intended to be limited to use in tanks, but may be effectively employed in any engine having an auxiliary fuel tank.

Figure 1:
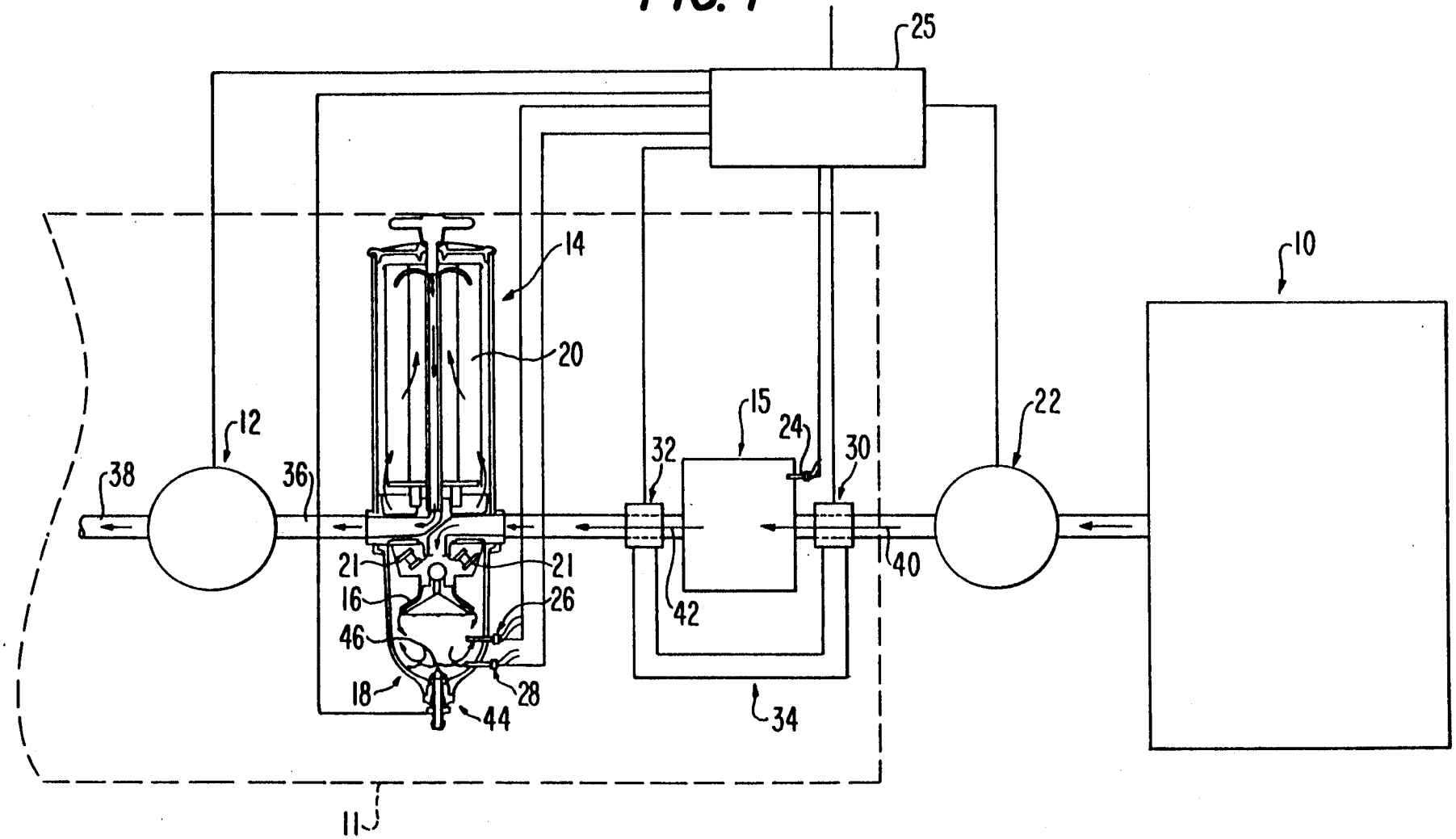
FIG. 1 is a schematic representation of the automatic fuel decontamination system during normal operation showing fuel flow through an auxiliary fuel tank.
Figure 2:
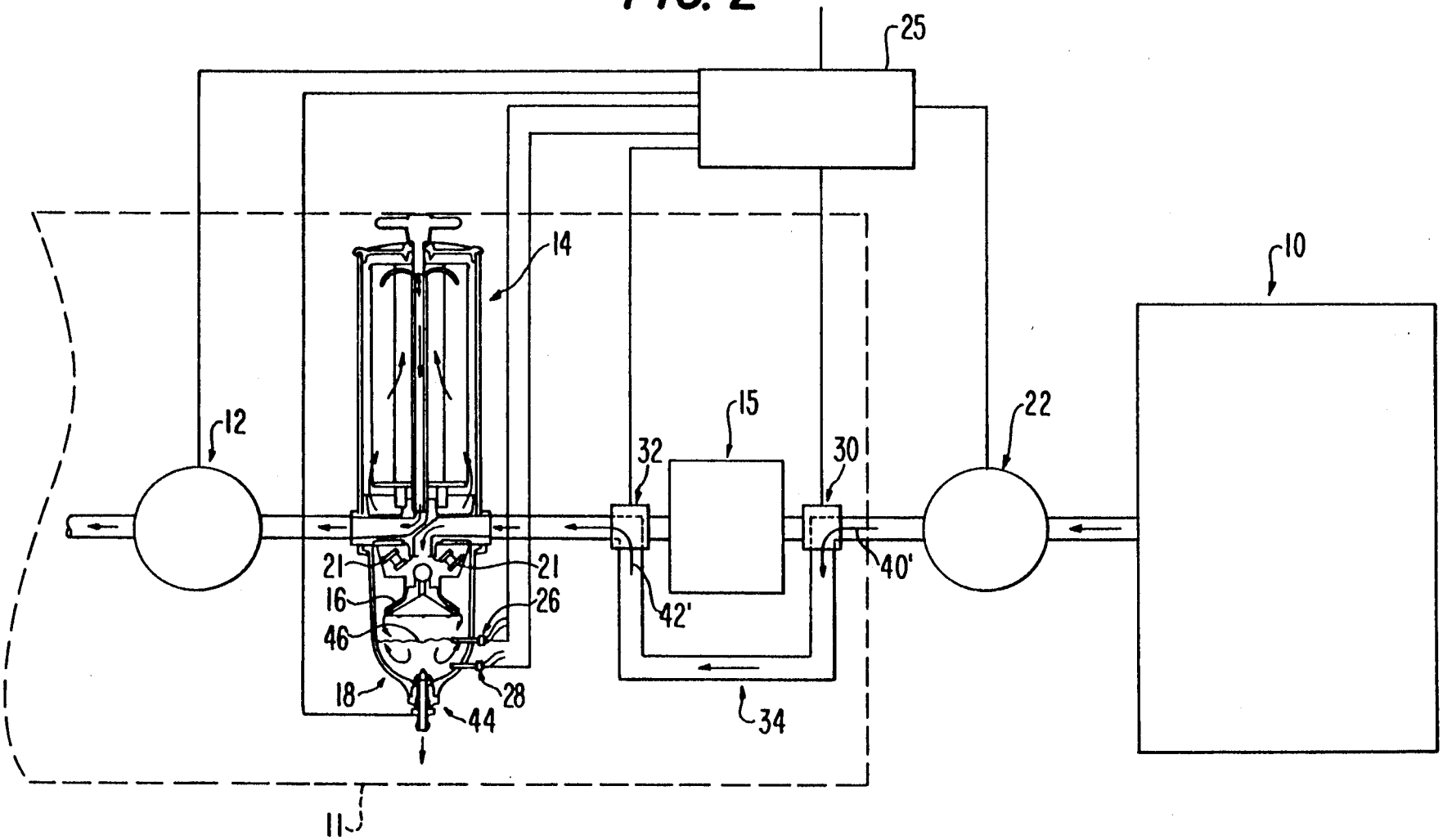
FIG. 2 is a schematic representation of the automatic fuel decontamination system during a water discharge mode showing fuel flow bypassing the auxiliary fuel tank.

The preferred embodiment of the present invention may best be understood by a study of accompanying FIGS. 1 and 2. FIG. 1 shows normal operation of the engine fuel supply system when a predetermined level of water is not exceeded in the discharge chamber. FIG. 2 shows operation of the present automatic fuel decontamination system in the water discharge mode, wherein water is purged from the system responsive to a build-up of water in the discharge chamber.

Referring now to FIG. 1, a main fuel tank 10 serves as a diesel fuel supply reservoir on a diesel powered vehicle, such as a battle tank. This type of vehicle typically uses a removable power pack 11 which includes a diesel engine (not shown), an injection pump 12 for injecting fuel into the engine, a fuel decontamination mechanism 14 for separating and discharging water from the fuel supplied to the engine, and an auxiliary fuel tank 15 for providing a fuel supply for the engine when the removable power pack 11 is separated from the main fuel tank 10.

The fuel decontamination mechanism 14 can comprise any commercially available fuel and water separator. Especially suitable for use in the present invention are the various models of fuel and water separators marketed by Parker Filtration under the trademark RACOR, one example being the RACOR model 1000FG.

The fuel decontamination mechanism 14 illustrated in FIGS. 1 and 2 and preferred for use in the present automatic fuel decontamination system uses a three-stage filtration system to remove virtually 100% of the damaging water and solid contaminants from diesel fuel. In the first stage of filtration, liquids and solids contaminating the fuel are separated out by centrifugal action created by a turbine centrifuge 16. The turbine centrifuge creates sufficient turbulence to cause liquids and solids more dense than the fuel to settle to the bottom of a discharge chamber 18. In the second stage of filtration, minute particles lighter (less dense) than the fuel collect in beads on a specially treated replacement element 21. As the beads accumulate, they become larger and heavier, causing them to fall as well to the bottom of discharge chamber 18. In the third and final stage of filtration, minute solids are removed from the fuel by the replacement element 20. Since particles removed during the third stage of filtration remain trapped in replacement element 20 and do not collect in the bottom of discharge chamber 18, the replacement element is not an essential part of the fuel decontamination mechanism 14. Nonetheless, a third stage of filtration is usually necessary at some point prior to fuel injection to remove small dust, dirt, rust and algae particles that could lead to blown injector tips, fouled injector nozzles, excessive pump, injector, and ring wear, loss of power, and overall poor performance.

To ensure that auxiliary fuel tank 15 contains an adequate fuel supply for the engine in the event that the power pack must be removed, a transfer pump 22 is provided for automatically refilling the tank whenever a low fuel level is detected by a fuel level sensor 24. Fuel level sensor 24 could for example, be a float mechanism or an optical or electronic probe within auxiliary fuel tank 15, or any other suitable liquid level detection apparatus.

In addition to the primary purpose of maintaining a desired level of fuel in auxiliary fuel tank 15, transfer pump 22 is also used to pressurize the fuel supply system during a startup mode, and to overcome negative pressure in the fuel decontamination mechanism 14 during a water discharge mode. Transfer pump 22 is thus a multipurpose pump capable of three distinct modes of operation: a startup mode, a normal operating mode and a contaminant discharge mode. Pump operation throughout each of the three modes of operation is preferably controlled by a command controller 25 which receives outputs from the vehicle ignition switch (not shown), the fuel level sensor 24 in auxiliary fuel tank 15, and two water level sensors 26, 28 within fuel decontamination mechanism 14.

The operation of the present automatic fuel decontamination system is best understood with respect to three modes of engine operation: the startup mode, normal operation, and the discharge mode.

Startup Mode

The vehicle starting switch (not shown) initiates the startup mode. When the switch is closed to start the engine, the command controller 25 responds first by energizing two three-way solenoid valves 30 and 32, thereby causing fuel flow to bypass auxiliary fuel tank 15 through an alternate flow path 34.

Any commercially available solenoid valve suitable for this purpose could be used. However, one type of three-way solenoid valve found to work particularly well in the present invention is the 713 series of three-way, direct acting, brass body directional solenoid valves available from the Skinner Valve Division of Honeywell.

After the solenoid valves 30, 32 have been energized, the command controller 25 next activates transfer pump 22 to pressurize the system. This pressurization is necessary to supercharge injection pump 12, which requires a minimum starting pressure of 60 psi in conduit 36. Once the engine has started, supercharged pressures are no longer required in conduit 36 because injection pump 12 will draw fuel through the conduit by a siphoning action given that the engine is not at a higher speed. Therefore, once the engine has been started, the command controller 25 reopens solenoid valves 30 and 32, permitting fuel to flow once again through auxiliary fuel tank 15. The startup mode serves to supercharge injection pump 12 without subjecting auxiliary tank 15 to excessive pressures. Since high pressure fuel bypasses auxiliary fuel tank 15, the walls of the auxiliary tank need not be designed to withstand high pressures. The fuel tank can therefore be manufactured using lighter weight, less expensive materials. As a result, the overall weight of the battle tank or other vehicle carrying the present system can be reduced.

Weight considerations are critical in a vehicle of this type due to the delicate balancing of maneuverability and speed of the vehicle versus the vehicle body integrity. The armor typically used on a battle tank has such excessive weight that the vehicle weight needs to be reduced however possible to offset the cumbersome nature of the vehicle. Perhaps even more importantly, since the auxiliary fuel tank is removable with the engine as a part of the removable power pack, providing a smaller and lighter auxiliary fuel tank will facilitate removal of the removable power pack 11.

Normal Operation

During normal operation of the automatic fuel decontamination system of the present invention, the fuel to be burned in the engine is drawn from auxiliary fuel tank 15 through solenoid valve 32 and fuel decontamination mechanism 14 by injection pump 12 in the direction shown by the arrows in FIG. 1. The fuel is then provided through conduit 38 to any conventional arrangement of fuel injectors to be injected into a combustion chamber in a conventional manner. As the fuel is burned, the level of fuel in auxiliary fuel tank 15 drops. When the fuel level drops below the sensor 24, a signal is sent to the command controller 25. The command controller in turn activates transfer pump 22 to refill auxiliary fuel tank 15 by pumping fuel from main fuel tank 10 through a main fuel path as indicated in FIG. 1 by arrow 40.

On its way to the engine from auxiliary tank 15 all fuel must pass through fuel decontamination mechanism 14. Because water has a higher density than diesel fuel, any water that may be mixed in with the fuel settles to the bottom of water discharge chamber 18, whereas the lower density fuel continues on through the decontamination mechanism and exits to the engine by way of conduits 36, 38.

As a result, water accumulates in the discharge chamber 18. An upper water level sensor 26 and a lower water level sensor 28 regulate when and for how long water will be purged from the system by way of a discharge valve 44. The two water level sensors 26, 28 are preferably either optically or electronically actuated since turbulence from turbine centrifuge 16 could impair the proper functioning of a mechanical float mechanism in the environment within the water discharge chamber. Discharge valve 44 is preferably solenoid actuated, and may, for example, be a two-way solenoid of the type known to be available from Automatic Switch Co. of Florham Park, N.J. Operation of the discharge valve 44 is automatic, as will be explained in detail below.

As shown in FIG. 1, the separation line between fuel and water in the discharge chamber 18 is designated by reference numeral 46. As more water falls into water discharge chamber 18, and accumulates, the separation line 46 moves upward until it reaches the level of upper sensor 26. At that time a signal is sent by upper sensor 26 to the command controller 25, and the command controller 25 accordingly changes the operation of the system from the normal mode to the discharge mode. Upper sensor 26 is positioned so water cannot rise to a level that interferes with proper functioning of turbine centrifuge 16 before water is drained through the discharge valve 44. Once the discharge of water begins, it continues until the separation line 46 between the fuel and the water recedes to the level of the lower sensor 28.

Discharge Mode

The operation of the system in the discharge mode is shown in FIG. 2. Upon receiving a signal from upper sensor 26 that the maximum water level in discharge chamber 18 has been reached, the command controller 25 first activates the two three-way solenoid valves 30, 32 and transfer pump 22, which causes the fuel flow to bypass auxiliary tank 15 as in the startup mode. A timing mechanism within the command controller 25 measures an elapsed time after the actuation of solenoid valves 30, 32 to delay the opening of discharge valve 44, which is also controlled by the command controller 25. The time lag, which is preferably in the range of 0.5 to 5 seconds, ensures that the system is adequately pressurized to overcome the negative pressure which exists in the fuel decontamination mechanism 14 so that air will not enter through discharge valve 44 when the valve is opened by the command controller 25.

Although a pressure sensor could be used in decontamination mechanism 14 as an alternative to the timing mechanism of the command controller, the pressure sensor would have to be deactivated during the startup mode to prevent water discharge from taking place during startup pressurization.

As in the startup mode, the system is pressurized in the discharge mode without subjecting auxiliary fuel tank 15 to excessive pressures because high pressure fuel bypasses the auxiliary fuel tank. The fuel flows through alternate flow path 34 as designated by arrows 40', 42' rather than through the normal mode flow path designated by arrows 40, 42 in FIG. 1. As water is discharged through discharge valve 44, the separation line 46 between the fuel and the water recedes downwardly. When separation line 46 is detected by lower sensor 28, the discharge valve 44 is closed by the command controller 25 to prevent the discharge of fuel through the discharge valve. At the same time, transfer pump 22 is switched off, allowing the pressure in the system to drop. Solenoid valves 30 and 32 are then deactivated, once again allowing fuel to flow into and out of auxiliary fuel tank 15. Normal operation is then resumed, and the transfer pump 22 is activated periodically to replenish the fuel supply in auxiliary the fuel tank 15.

Because a steady supply of fuel is provided by transfer pump 22 throughout operation in the discharge mode, there is no need to stop the engine during the discharge operation. Additionally, since the same pump is used in all three modes of operation, the cost of production and materials of the fuel supply system is kept low. While the automatic fuel decontamination system of the present invention has been discussed with regard to removing water from fuel, it should be understood that the present invention would effectively remove any contaminating liquid having a higher density than the fuel.

Industrial Applicability

The primary application of the invention is to provide the automatic separation and discharge of water contaminants from a removable power pack in a diesel engine-powered battle tank. The present automatic fuel decontamination system invention could also be used to remove water and similar contaminants from the fuel supply system of any internal combustion engine having an auxiliary fuel tank supplied with fuel from a main fuel tank.

I claim:

1. An internal combustion engine fuel supply system incorporating automatic fuel decontamination means for separating and automatically discharging water from the internal combustion engine fuel supply system during operation of said engine, including a main fuel tank fluidically connected to an auxiliary fuel tank, a fuel transfer pump fluidically connected between said main fuel tank and said auxiliary fuel tank and an injection pump fluidically connected between said engine and said auxiliary fuel tank, said decontamination means comprising:

control means for controlling the transfer of fuel from said main fuel tank to said engine, and the discharge of water from the fuel supply system; water separation means;

bypass means for providing an alternate fuel flow passage for bypassing said auxiliary fuel tank and for fluidically connecting said fuel transfer pump to the water separation means when the water in said water separation means exceeds a predetermined maximum level; and valve means responsive to said control means for shutting off fuel flow through a main fuel path through said auxiliary fuel tank and routing fuel flow through said alternate flow path;

said water separation means being fluidically interposed between said auxiliary fuel tank and said injection pump for separating water from fuel and accumulating water in a discharge chamber, said discharge chamber including an upper limit sensing means connected to said control means for sensing a maximum water level and a lower limit sensing means connected to said control means for sensing a minimum water level, said discharge chamber further including discharge valve means responsive to said control means for automatically discharging water from said discharge chamber when water in said discharge chamber reaches said maximum level as sensed by said upper limit sensing means.

2. The fuel supply system of claim wherein said valve means includes a first three-way solenoid valve upstream of said auxiliary fuel tank and a second three-way solenoid valve downstream of said auxiliary fuel tank, and said first and second three-way solenoid valves are actuatable by said control means between a first position permitting flow to said auxiliary fuel tank and a second position closing off flow to said auxiliary fuel tank in response to the sensed level of water in said discharge chamber.

3. The fuel supply system of claim 2, wherein fuel flow is directed through said main fuel path when said solenoid valves are in said first position and fuel flow is directed through said alternate flow path when said solenoid valves are in said second position.

4. The fuel supply system of claim 1 wherein said internal combustion engine is a compression ignition engine and said fuel supply system supplies diesel fuel to said compression ignition engine.

5. The fuel supply system of claim 4 wherein said auxiliary fuel tank, said injection pump, and said compression ignition engine are fixed together as an integral unit which is removable and replaceable on a vehicle carrying said main fuel tank and wherein when said integral unit is removed from said vehicle, said injection pump pumps fuel to said compression ignition engine from said auxiliary fuel tank.

6. A method of removing water from the fuel supply system of an operating internal combustion engine, said fuel supply system including an auxiliary fuel tank, a fuel transfer pump and a water separator and discharge element in fluid connection between a main fuel tank and a fuel injector pump, wherein fuel is pumped by said transfer pump from the main fuel tank through the auxiliary fuel tank and then through the water separator and discharge element to the injector pump, said method including the steps of:

(a) detecting water in said water separator and discharge element in excess of a sensed predetermined maximum;

(b) actuating said fuel transfer pump and a diverter valve means to pump and divert, respectively, fuel flow through a bypass means bypassing said auxiliary fuel tank and fluidically connecting said main fuel tank to said internal combustion engine through said water separator and discharge element;

(c) actuating a water discharge valve in said water separator and discharge element when a predetermined time has elapsed after said diverter valve means has been actuated;

(d) discharging water from said water separator and discharge element until the water level therein reaches a sensed predetermined minimum;

(e) deactuating said water discharge valve to stop the discharge of water from said water separator and discharge element; and (f) deactuating said fuel transfer pump and said diverter valve means, thereby re-establishing fuel flow through said auxiliary fuel tank.

7. An internal combustion engine fuel supply system incorporating an automatic system for removing water from the fuel supply system, including an auxiliary fuel tank fluidically connected between a main fuel tank and a fuel injector pump and a fuel transfer pump fluidically connected between said main fuel tank and said auxiliary fuel tank, said automatic water removal system comprising:

(a) fuel/water separator means for separating water from the fuel supply system, fluidically connected between said auxiliary fuel tank and said fuel injector pump;

(b) water discharge means in said fuel/water separator means for discharging water from said fuel/water separator;

(c) duel water level sensing means in said fuel/water separator means for sensing a first, predetermined maximum level of water and second, predetermined minimum level of water;

(d) bypass means for fluidically connecting said fuel transfer pump to said engine through said fuel/water separator means by diverting fuel flow around said auxiliary fuel tank when said dual water level sensing means senses a maximum level of water in said fuel/water separator means; and (e) command control means for sequentially actuating said bypass means in response to the sensed predetermined maximum water level, for actuating said water discharge means to discharge water from said fuel/water separator and deactuating said water discharge means when the predetermined minimum water level has been sensed, and for deactuating said bypass means in response to the sensed predetermined minimum water level to allow fuel flow through said auxiliary fuel tank.

8. The automatic water removal system described in claim 7, wherein said water discharge means comprises a solenoid valve responsive to said command control means, said command control means opening said valve following a predetermined time period after actuation of said bypass means and closing said valve when said predetermined minimum water level has been sensed.

9. The automatic water removal system described in claim 7, wherein said bypass means comprises first and second bypass valves fluidically connected to said auxiliary fuel tank and to a fuel bypass passage so that fuel is diverted around said auxiliary fuel tank through said first bypass valve to said fuel bypass passage and then through said second bypass valve to said fuel/water separator means.

10. The automatic water removal system described in claim 9, wherein said first and second bypass valves are solenoid valves responsive to said command controller.

11. The automatic water removal system described in claim 9, wherein said fuel/water separator means includes a fuel conduit fluidically connected with said fuel bypass passage through said second bypass valve, thereby permitting fuel flow through said fuel/water separator means when said bypass valves are actuated to divert fuel flow around said auxiliary fuel tank.

* * * * *